US009754555B2

(12) United States Patent
Wu

(10) Patent No.: US 9,754,555 B2
(45) Date of Patent: Sep. 5, 2017

(54) METHOD FOR ADJUSTING DISPLAY OF ELECTRONIC DEVICE AND ELECTRONIC DEVICE CAPABLE OF ADJUSTING DISPLAY

(71) Applicant: MEDIATEK INC., Hsin-Chu (TW)

(72) Inventor: Yi-Ruei Wu, Tainan (TW)

(73) Assignee: MEDIATEK INC., Hsin-Chu (TW)

( * ) Notice: Subject to any disclaimer, the term of this patent is extended or adjusted under 35 U.S.C. 154(b) by 109 days.

(21) Appl. No.: 14/820,528

(22) Filed: Aug. 6, 2015

(65) Prior Publication Data

US 2017/0039994 A1 Feb. 9, 2017

(51) Int. Cl.
*G09G 5/10* (2006.01)

(52) U.S. Cl.
CPC ..... *G09G 5/10* (2013.01); *G09G 2320/0653* (2013.01); *G09G 2340/14* (2013.01); *G09G 2354/00* (2013.01); *G09G 2360/144* (2013.01); *G09G 2360/145* (2013.01); *G09G 2360/16* (2013.01)

(58) Field of Classification Search
CPC ..... G09G 2320/0626; G09G 2360/16; G09G 2320/0686; G09G 2320/0233; G09G 2320/062; G09G 3/3406
See application file for complete search history.

(56) References Cited

U.S. PATENT DOCUMENTS

2005/0271379 A1* 12/2005 Lee ..... H04N 5/2351 396/234
2012/0293473 A1 11/2012 Lee et al.
2014/0132641 A1* 5/2014 Hussain ..... G09G 5/10 345/690
2015/0367779 A1* 12/2015 Ohdachi ..... G08G 1/0967 340/905
2016/0100140 A1* 4/2016 Hsiao ..... H04N 9/3182 353/85
2017/0018239 A1 1/2017 Chen et al.

* cited by examiner

*Primary Examiner* — Gerald Johnson
(74) *Attorney, Agent, or Firm* — Han IP Corporation; Andy M. Han

(57) ABSTRACT

The present disclosure provides a method and an electronic device capable of performing a display adjustment. The method comprises: obtaining a first brightness value corresponding to light flux to enter user eyes at a first time; obtaining a second brightness value corresponding to light flux to enter user eyes at a second time later than the first time; determining whether a brightness difference between the first brightness value and the second brightness value is greater than a threshold value; and in events where the brightness difference between the first brightness value and the second brightness value is greater than the threshold value, enabling an adjustment mode of the electronic device, wherein the adjustment mode comprises increasing a transition time period of a transition from the first brightness value to the second brightness value and adjusting either of both of brightness of a backlight and brightness of a screen content according to the transition from the first brightness value to the second brightness value with the increased transition time.

22 Claims, 5 Drawing Sheets

METHOD FOR ADJUSTING DISPLAY OF ELECTRONIC DEVICE AND ELECTRONIC DEVICE CAPABLE OF ADJUSTING DISPLAY

BACKGROUND

The disclosed embodiments of the present invention relate to a method and an electronic device capable of performing a display adjustment, and more particularly, to a method and an electronic device capable of enabling an adjustment mode to gradually adjust brightness of a screen to increase a transition time period of the brightness of the screen.

In general, the diameter of pupils in human eyes adapt to brightness of environment lights. In dark environment, the diameter of pupil increases, but in strong light, it quickly decreases. However, when there is a large and abrupt brightness variation, it is hard for the human eyes to instantly adapt to the brightness variation and clearly see the display content. In other words, an abrupt and excessive variation in light flux entering human eyes is an uncomfortable condition for the human eyes, causing a bad user experience.

SUMMARY

It is therefore one of the objectives of the disclosure to provide a method for adjusting display of an electronic device and an electronic device capable of performing a display adjustment to adjust screen brightness to be more appropriate for human eyes capability, so as to solve the problem mentioned above.

In accordance with an embodiment of the present invention, a method for adjusting display of an electronic device is disclosed. The method comprises: obtaining a first brightness value corresponding to light flux to enter user eyes at a first time; obtaining a second brightness value corresponding to light flux to enter user eyes at a second time later than the first time; determining whether a brightness difference between the first brightness value and the second brightness value is greater than a threshold value; and in events where the brightness difference between the first brightness value and the second brightness value is greater than the threshold value, enabling an adjustment mode of the electronic device, wherein the adjustment mode comprises increasing a transition time period of a transition from the first brightness value to the second brightness value, such that the increased transition time period between the first brightness value and the second brightness value is longer than a time difference between the first time and the second time; and adjusting either of both of brightness of a backlight and brightness of a screen content according to the transition from the first brightness value to the second brightness value with the increased transition time.

In accordance with another embodiment of the present invention, a method for adjusting display of an electronic device is disclosed. The method comprises: obtaining a first brightness value corresponding to a first time; obtaining a second brightness value corresponding to a second time later than the first time; determining whether to enable an adjustment mode of the electronic device according to a difference between the first brightness value and the second brightness value, wherein the adjustment mode comprises: increasing a transition time period between the first brightness value and the second brightness value, and adjusting either of both of brightness of a backlight and brightness of a screen content according to the transition from the first brightness value to the second brightness value with the increased transition time.

In accordance with another embodiment of the present invention, a method for adjusting display of an electronic device is disclosed. The method comprises: obtaining a first brightness value corresponding to light flux to enter user eyes at a first time; obtaining a second brightness value corresponding to light flux to enter user eyes at a second time later than the first time; determining whether a brightness difference between the first brightness value and the second brightness value is greater than a threshold value; and in events where the brightness difference between the first brightness value and the second brightness value is greater than the threshold value, enabling an adjustment mode, wherein the adjustment mode comprises transforming a transition from the first brightness value to the second brightness value from a step transition to a gradual transition, and adjusting either of both of brightness of a backlight and brightness of a screen content according to the gradual transition from the first brightness value to the second bright value.

In accordance with an embodiment of the present invention, a method for adjusting display of an electronic device is disclosed. The method comprises: obtaining a first brightness value corresponding to light flux to enter user eyes at a first time; obtaining a second brightness value corresponding to light flux to enter user eyes at a second time later than the first time; adjusting a transition period of a transition from the first brightness value to the second brightness according to a brightness difference between the first brightness value and the second brightness value; and adjusting either of both of brightness of a backlight and brightness of a screen content according to the transition from the first brightness value to the second bright value with the increased transition time.

In accordance with an embodiment of the present invention, a method for adjusting display of an electronic device is disclosed. The method comprises: obtaining one or more brightness values according to display content brightness value and at least one of a backlight brightness value and an ambient brightness value, wherein each of the one or more brightness values affects light flux entering user eyes; obtaining human eye capability information from a database or any storage form or a predefined formula implemented by software, hardware, or a combination thereof; judging whether the one or more brightness values satisfy one or more predetermined conditions; and in events where the one or more brightness values satisfy one or more predetermined conditions, enabling a display adjustment on brightness according to the human eye capability information, and adjusts either of both of brightness of a backlight and brightness of a screen content accordingly.

In accordance with an embodiment of the present invention, an electronic device capable of performing a display adjustment is disclosed. The system comprises: a detecting unit and a processing unit. The detecting unit is utilized for obtaining a first brightness value corresponding to light flux to enter user eyes at a first time and obtaining a second brightness value corresponding to light flux to enter user eyes at a second time later than the first time. The processing unit can be coupled to or communicate with the detecting unit, and utilized for determining whether a brightness difference between the first brightness value and the second brightness value is greater than a threshold value; wherein in events where the brightness difference between the first brightness value and the second brightness value is greater than the threshold value, the processing unit enables an adjustment mode of the electronic device, wherein the adjustment mode comprises increasing a transition time period of a transition from the first brightness value to the second brightness value, such that the increased transition time period between the first brightness value and the second brightness value is longer than a time difference between the first time and the second time, and adjusting either of both of brightness of a backlight and brightness of a screen content according to the transition from the first brightness value to the second bright value with the increased transition time.

In accordance with an embodiment of the present invention, an electronic device capable of performing a display adjustment is disclosed. The system comprises: a detecting unit and a processing unit. The detecting unit is utilized for obtaining a first brightness value corresponding to light flux to enter user eyes at a first time and obtaining a second brightness value corresponding to light flux to enter user eyes at a second time later than the first time. The processing unit can be coupled to or communicate with the detecting unit, and utilized for determining whether a brightness difference between the first brightness value and the second brightness value is greater than a threshold value; wherein in events where the brightness difference between the first brightness value and the second brightness value is greater than the threshold value, the processing unit enables an adjustment mode, wherein the adjustment mode comprises transforming a transition from the first brightness value to the second brightness value from a step transition to a gradual transition, and adjusting either of both of brightness of a backlight and brightness of a screen content according to the gradual transition from the first brightness value to the second bright value.

In accordance with an embodiment of the present invention, an electronic device capable of performing a display adjustment is disclosed. The system comprises: a detecting unit and a processing unit. The detecting unit is utilized for obtaining a first brightness value corresponding to light flux to enter user eyes at a first time and obtaining a second brightness value corresponding to light flux to enter user eyes at a second time later than the first time. The processing unit can be coupled to or communicate with the detecting unit, configured to adjust a transition period of a transition from the first brightness value to the second brightness according to a brightness difference between the first brightness value and the second brightness value and adjusting either of both of brightness of a backlight and brightness of a screen content according to the transition from the first brightness value to the second bright value with the increased transition time.

In accordance with an embodiment of the present invention, an electronic device capable of performing a display adjustment is disclosed. The system comprises: a detecting unit and a processing unit. The detecting unit is utilized for obtaining one or more brightness values according to display content brightness value and at least one of a backlight brightness value and an ambient brightness value, wherein each of the one or more brightness values affects light flux entering user eyes. The processing unit can be coupled to or communicate with the detecting unit, and utilized for obtaining human eye capability information from a database or any storage form or a predefined formula implemented by software, hardware, or a combination thereof and judging whether the one or more brightness values satisfy one or more predetermined conditions; wherein in events where the one or more brightness values satisfy one or more predetermined conditions, the processing unit enables a display adjustment on brightness according to the human eye capability information, and adjusts either of both of brightness of a backlight and brightness of a screen content accordingly.

In accordance with an embodiment of the present invention, an electronic device capable of performing a display adjustment is disclosed. The electronic device comprises a detecting unit, configured to obtain a first brightness value corresponding to a first time, and obtain a second brightness value corresponding to a second time later than the first time; and a processing unit, configured to determine whether to enable an adjustment mode of the electronic device according to a difference between the first brightness value and the second brightness value, wherein the adjustment mode comprises: increasing a transition time period between the first brightness value and the second brightness value, and adjusting either of both of brightness of a backlight and brightness of a screen content according to the transition from the first brightness value to the second brightness value with the increased transition time.

Briefly summarized, the method and the electronic device disclosed by the embodiments can adjust display of an electronic device by enabling the adjustment mode of the electronic device to adjust the brightness of the screen to increase a transition time period when the brightness variation is large. In addition, the adjustment can be performed based on human eye capability information, which may comprise either of both of human eye adapting information and human eye sensitivity information. By considering the capability of human eye to adapt to the variation in brightness or light flux entering them in the display adjustment, the embodiment can make screen brightness easier for human eyes to perceive and thus greatly reduce the uncomfortable feeling of human eyes. Accordingly, the embodiments can solve the problem that user eyes are not able to instantly adapt to the large brightness variation in and clearly see the display content.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to". Also, the term "couple" is intended to mean either an indirect or direct electrical connection. Accordingly, if one device is coupled to another device, that connection may be through a direct electrical connection, or through an indirect electrical connection via other devices and connections.

Embodiments of the disclosure provide a method for adjusting display of an electronic device and an electronic device capable of performing a display adjustment. According to the embodiment, a pupil size or a human eye adaptive level can be estimated by current light flux and environment light. And a variation speed of the pupil size or a human eye adaptive speed can be estimated based on subsequent light flux that the current flux will transition to and the estimated pupil size (or the estimated human eye adapting level). And based on the estimated variation speed of the pupil size (or the human eye adaptive speed), either or both of brightness of a backlight or brightness of a screen content can be adjusted. The adjustment can prevent excessive variation in the light flux that causing adaption difficulties in human eyes. Accordingly, uncomfortable feelings of human eyes during transition of frames can be prevented or reduced, and the screen content in the transition can be seen more clearly by the human eyes.

In one embodiment, brightness of screen content can be adjusted to vary gradually to avoid an abrupt change in the whole brightness. In another embodiment, the backlight brightness is adjusted to vary gradually along with variation in the screen content such that the whole brightness is not varied abruptly. In further another embodiment, the screen content and the backlight brightness are both adjusted. In an alternative embodiment, an ancillary light can be utilized which illuminate light onto the eyes and compensate environment light, thus decrease the variation speed of the whole brightness. In further another alternative embodiment, one or more light filter device can be implemented on the screen to control light flux of the screen, and the transmission rate or shading rate of the one or more filters can be slowly adjusted. In one embodiment, a contrast value during a transition from a higher brightness value to a lower brightness value can be increased, allowing human eyes to see more easily.

Figure 1:
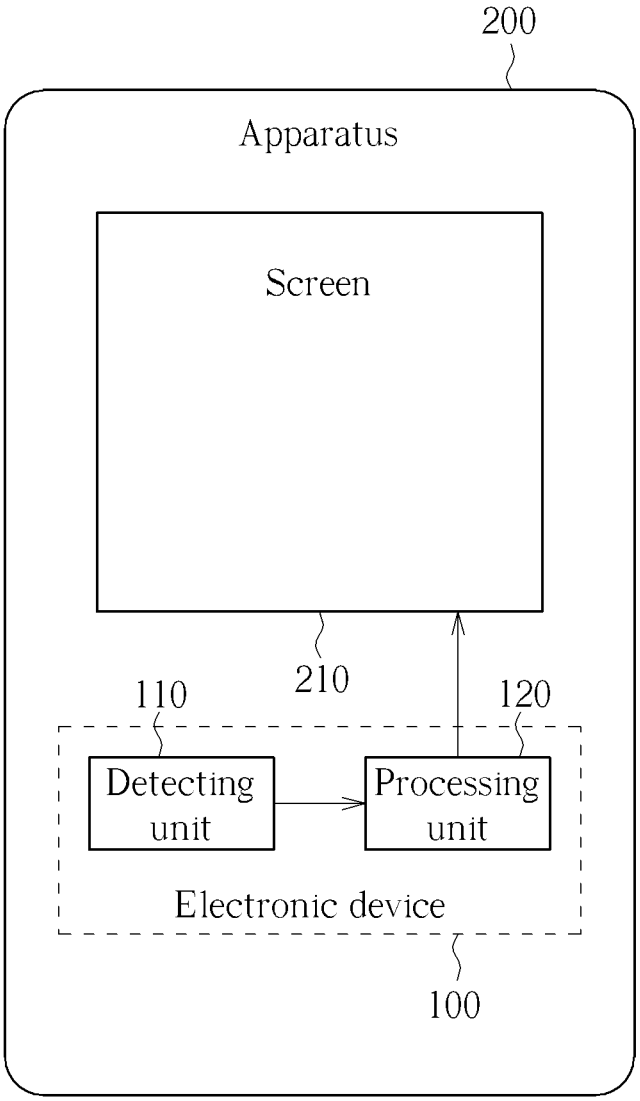
FIG. 1 is a simplified diagram of an electronic device capable of performing a display adjustment in accordance with an embodiment of the present invention.

Please refer to FIG. 1. FIG. 1 is a simplified diagram of an electronic device capable of performing a display adjustment in an apparatus 200 in accordance with an embodiment of the present invention, wherein the apparatus 200 comprises a screen 210 and the electronic device 100, and the apparatus 200 can be a smartphone, a tablet, a laptop, a handheld computing device, or a television. The electronic device 100 can be any electronic device capable of controlling/driving a display of the screen 210 or providing display content to the screen 210. In the embodiment, the electronic device 100 comprises: a detecting unit 110 and a processing unit 120. The detecting unit 110 is utilized for obtaining a first brightness value corresponding to light flux to enter user eyes at a first time and obtaining a second brightness value corresponding to light flux to enter user eyes at a second time later than the first time. The processing unit 120, which may be coupled to or communicate with the detecting unit 110, and utilized for determining whether to enable an adjustment mode according to judging whether a predetermined condition is met or not. The predetermined condition can be a condition indicative an excessively abrupt change of the brightness value corresponding to light flux entering user eyes. For example, the predetermined condition may be that a brightness difference between the first brightness value and the second brightness value is greater than a threshold value.

In events where the brightness difference between the first brightness value and the second brightness value is greater than the threshold value, the processing unit 120 enables the adjustment mode, wherein the adjustment mode comprises increasing a transition time period of a transition from the first brightness value to the second brightness value, such that the increased transition time period between the first brightness value and the second brightness value is longer than a time difference between the first time and the second time. Conversely, in events where the brightness difference between the first brightness value and the second brightness value is less than the threshold value, the processing unit 120 disables the adjustment mode of the apparatus 200, such that the transition time period between the first brightness value and the second brightness value is maintained to be equal to the time difference between the first time and the second time.

It is noted that, the time difference between the first time and the second time can be one or more frame update period and preferably but not limitedly, equal to a frame update period. In other words, the first brightness value corresponding to the light flux to enter the human eyes at the first time may be associated with a first frame, and the second brightness value corresponding to the light flux to enter the human eyes at the second time may be associated with a second frame, wherein the first and second frames are preferably but not limitedly adjacent two frames.

In addition, the brightness value corresponding to the light flux to enter the human eyes at either of the first and second times can be determined according to a screen brightness value to be displayed on the screen 210 and an ambient brightness value. In a non-limiting example, the light flux entering the human eyes at time t, denoted by brightness variation function K'(t), can be expressed as $K'(t)=W_a \times L_a + W_b \times L'(t)$, where Wa denotes a weight for the ambient brightness value, La denotes the ambient brightness value, Wb denotes a weight for the screen brightness value, and L'(t) denotes the screen brightness value to be displayed on the screen 210 at time t. Specifically, in obtaining the first brightness value corresponding to the light flux to enter the human eyes at the first time, the first brightness value can be determined according to a first screen brightness value to be displayed on the screen 210 at the first time and the ambient brightness value. Similarly, in obtaining the second brightness value corresponding to the light flux to enter the human eyes at the second time, the second brightness value can be determined according to a second screen brightness value to be displayed on the screen 210 at the second time and the ambient brightness value.

In one embodiment, the increasing the transition time period between the first brightness value and the second brightness value can be implemented by adjusting a screen brightness value to be displayed on the screen 210. The screen brightness value to be displayed on the screen 210 can be adjusted by adjusted either or both of a backlight brightness value and a displayed content brightness value. Alternatively or additionally, either or both of an ancillary light disposed for the screen or a transmission rate or a shading rate of one or more filtering devices of the screen can be adjusted.

In another embodiment, in the adjustment mode the processing unit 120 can further adds a contrast variation to brightness during the transition time period. Specifically, the detecting unit 110 can further obtains a first contrast value to be displayed on the screen 210 of the apparatus 200 at the first time, and obtains a second contrast value to be displayed on the screen at the second time. And the processing unit 120 can add the contrast variation to the brightness during transition time period by first increasing a contrast value from the first contrast value and then gradually decreasing the contrast value of the pixel data to the second contrast value during the transition period. The contrast value may be a brightness value remapped from pixel data of content or data of pixels or cells of a display panel undergoing brightness/gain adjustment, or a combination of both.

In one embodiment, to perform the adjustment mode, the processing unit 120 can further obtains human eye brightness adapting information from a database or any storage form or a predefined formula implemented in any form such as software, hardware or a combination thereof, and increases the transition time period between the first brightness value and the second brightness value according to the human eye brightness adapting information. The human eye brightness adapting information may comprise a human eye adapting rate. To increase the transition time period between the first brightness value and the second brightness value, the processing unit 120 can gradually increase a brightness value corresponding to light flux to enter the user eyes from the first brightness value to the second brightness value with an increment, wherein the increment is proportional to the human eye adapting rate. Accordingly, the processing unit 120 can gradually increase the brightness value with a rate approximating, fitting, or conforming to the human adapting rate.

In one embodiment, in obtaining the human eye adapting rate, the processing unit 120 obtains a human eye adapting level corresponding to light flux currently entering user eyes, and determines the human eye adapting rate by referring to a preconfigured human eye adapting function with the human eye adapting level.

Figure 2:
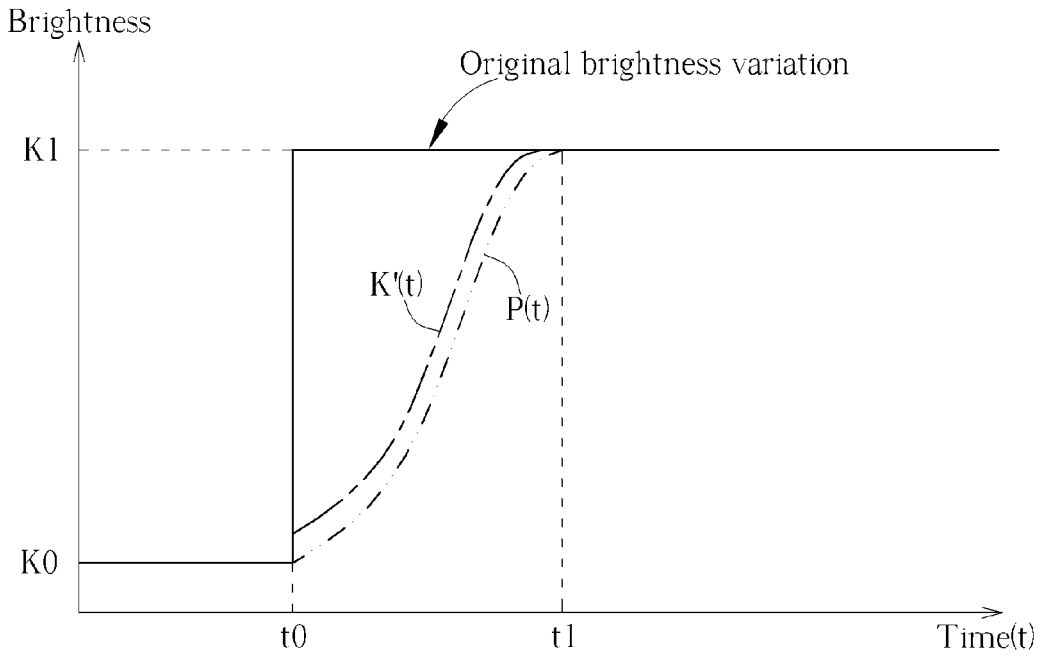
FIG. 2 is a simplified time diagram of the adjustment mode of an electronic device enabled by the system in accordance with an embodiment of the present invention.

Please refer to FIG. 2, which is a simplified time diagram of the adjustment mode enabled by an electronic device in accordance with an embodiment of the present invention. The time diagram may be utilized for explain a method for adjusting display of an electronic device and an electronic device (e.g., the electronic device 100 in FIG. 1) capable of performing a display adjustment. In the diagram, K0 represents a first brightness value, K1 represents a second brightness value, both of which originally occur at a first time to. However, actually, there is a time difference between the first brightness value K0 and the second brightness value. The time difference may be one or more frame update periods.

Specifically, the original brightness variation in the form of a step or abrupt transition is not good for the user eyes, and the user eyes are not able to instantly adapt to the large brightness variation and clearly see the displayed content. To solve this, an adjustment mode can be enabled in a predetermined condition, which may be that the brightness variation is bigger than a threshold Kh (i.e. $|K1-K0|>Kh$). After the adjustment, the step or abrupt transition can be transformed into a gradual transition indicated by K'(t). K'(t) represents a brightness variation function desired to achieve by performing the adjustment mode. As shown, K'(t0)=K0 and K'(t1)=K1. In other words, when the predetermined condition indicating an abrupt change of the brightness value, (e.g., $|K1-K0|>Kh$), the adjustment mode can be enabled to adjust the brightness of the screen 210 to make the K'(t) to gradually transition from K0 to K1 (or K1 to K0) during an increased transition time period (i.e. between t0 to t1). The second brightness after the adjustment is therefore delayed to occur at adjusted second time t1. In other words, the transition time period between the first brightness value and the second brightness value, i.e, t0–t0, is increased to be longer than the time difference between the first time and the second time. Conversely, when the predetermined condition is not met (e.g., $|K1-K0|<Kh$), the adjustment mode is disabled.

P(t) represents a human eye adapting function, which can be utilized to determine the brightness variation function K'(t). Preferably but not limitedly, the brightness variation function K'(t) can be determined to approximate, fit, or conform to the human eye adapting function P(t). For example, $K'(t)=K'(t-1)+V_d(P(t-1))\times e_d+f_d$, wherein $V_d(P(t))$ represents a human eye adaptive speed, $e_d$ represents an additional brightening ratio (for example, it can be 1), $f_d$ represents an additional brightening constant (for example, it can be 0). It is noted that K'(t) can be any function related to K'(t−1) and $V_d(P(t-1))$ determined by design requirements in different implementations.

In one embodiment, after the desired K'(t) is obtained, the screen brightness value L'(t) can be obtained according to K'(t). And then either of both of a backlight brightness value B(t) and a displayed content brightness value C(t) can be obtained to achieve the desired K'(t). For example, L'(t) can be determined by the following equation: $L'(t)=(K'(t)-Wa\times La)/Wb$, where Wa denotes a weight for the ambient brightness value, La denotes the ambient brightness value, Wb denotes a weight for the screen brightness value, and L'(t) denotes the screen brightness value to be displayed on the screen 210 at time t. Assume the screen has a transmission rate equal to 1, then $L'(t)=B(t)\times C(t)$, where C(t) can be expressed as $C(t)=(\Sigma g\ (\text{pixel values}))$, where g denotes a gamma function of the screen. In an implementation where only the backlight value is adjusted, after K'(t) is obtained according to the human eye adapting function P(t), the backlight value B(t) to be achieved can be expressed as $B(t)=C(t)/L'(t)$, so as to achieve the desired gradual transition of the brightness value. In another implementation where only the displayed content brightness value is adjusted, the displayed content brightness value C(t) to be achieved can be expressed as $C(t)=B(t)/L'(t)$ and an adjusted pixel value=C(t)/C'(t)×(an original pixel value), where C'(t) denotes a original displayed content brightness value.

The human eye adapting function P(t) can be indicated by human eye capability information, which can reflect how the human eyes are capable of reacting to or sensing variation in brightness or light flux entering them. In one embodiment, the human eye capability information can comprise one of human eye adapting information, which may in form of P(t) or any other forms or formula. The human eye adapting information may only be required to indicate how a human eye adaptive level changes during the transition. Additionally or alternatively, the human eye capability information can include human eye sensitivity information. The human eye adapting information may indicate how a human eye sensitive level changes during the transition. The human eye capability information can be implemented in a database or any storage form or a predefined formula implemented by software, hardware, or a combination thereof and judging whether the one or more brightness values satisfy one or more predetermined conditions. By considering the capability of human eye to adapt to the variation in brightness or light flux entering them in the display adjustment, the embodiment can provide screen brightness easier for human eyes to perceive and thus greatly reduce the uncomfortable feeling of human eyes.

Figure 3:
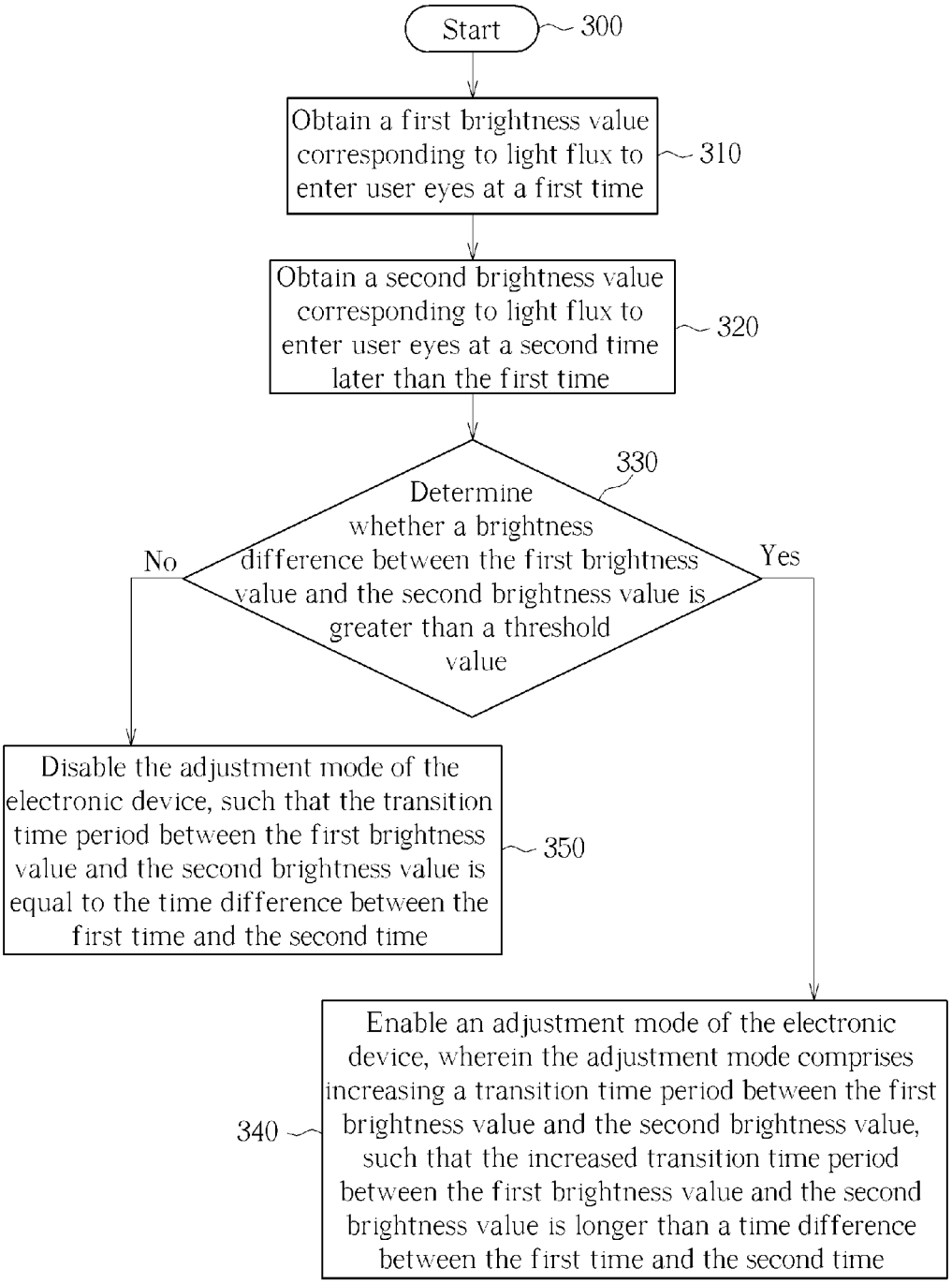
FIG. 3 is a first exemplary flowchart showing a method in accordance with operation schemes of an electronic device capable of performing a display adjustment in one embodiment.

Please refer to FIG. 3. FIG. 3 is a first exemplary flowchart showing a method in accordance with operation schemes of an electronic device capable of performing a display adjustment in one embodiment. The method may be applied to the apparatus 100 or the electronic device 100 in FIG. 2 but not limited thereto. Provided that the result is substantially the same, the steps in FIG. 3 are not required to be executed in the exact order shown in FIG. 3. The method in accordance with the above embodiment of the electronic device 100 in the present invention comprises the following steps:

Step 300: Start.

Step 310: Obtain a first brightness value corresponding to light flux to enter user eyes at a first time.

Step 320: Obtain a second brightness value corresponding to light flux to enter user eyes at a second time later than the first time.

Step 330: Determine whether a brightness difference between the first brightness value and the second brightness value is greater than a threshold value.

Step 340: Enable an adjustment mode of the electronic device, wherein the adjustment mode comprises increasing a transition time period of a transition from the first brightness value to the second brightness value, such that the increased transition time period of the transition between the first brightness value and the second brightness value is longer than a time difference between the first time and the second time. In addition, the adjustment mode further comprises adjusting a screen brightness value to be displayed on a screen according to the transition from the first brightness value to the second brightness value with the increased transition time.

Step 350: Disable the adjustment mode of the electronic device, such that the transition time period between the first brightness value and the second brightness value is equal to the time difference between the first time and the second time.

The step 310 of obtaining the first brightness value corresponding to light flux to enter human eyes for the first frame can comprise determining the first brightness value according to a first screen brightness value to be displayed on a screen at the first time and an ambient brightness value. The step 320 of obtaining the second brightness value corresponding to light flux to enter human eyes for the second frame can comprise determining the second brightness value according to a second screen brightness value to be displayed on the screen at the second time and the ambient brightness value. The step 330 comprises determining whether a brightness difference between the first brightness value and the second brightness value is greater than a threshold value. However, other different predetermined conditions preferably but not limitedly indicating an abrupt or sudden or excessive variation of brightness value may be utilized. The step 340 may be implemented by any available methods for adjusting the screen brightness value, e.g., adjusting one or more of a backlight brightness value, a displayed content brightness value, an ancillary light of the screen, and one or more filtering devices of the screen. Details of each step can be analogized form the above embodiments and thus omitted here for brevity.

In another embodiment, the adjustment mode in the step 340 can further comprise: obtaining a first contrast value to be displayed on a screen of the electronic device at the first time; and obtaining a second contrast value to be displayed on the screen at the second time; wherein the step of adding the contrast variation to the pixel data during transition time period comprises: during the transition time period, first increasing a contrast value from the first contrast value and then gradually decreasing the contrast value to the second contrast value. The contrast value may be a brightness value remapped from pixel data of content or data of pixels or cells of a display panel undergoing brightness/gain adjustment, or a combination of both. However, this is only for an illustrative purpose and is not meant to be a limitation of the present invention.

Figure 4:
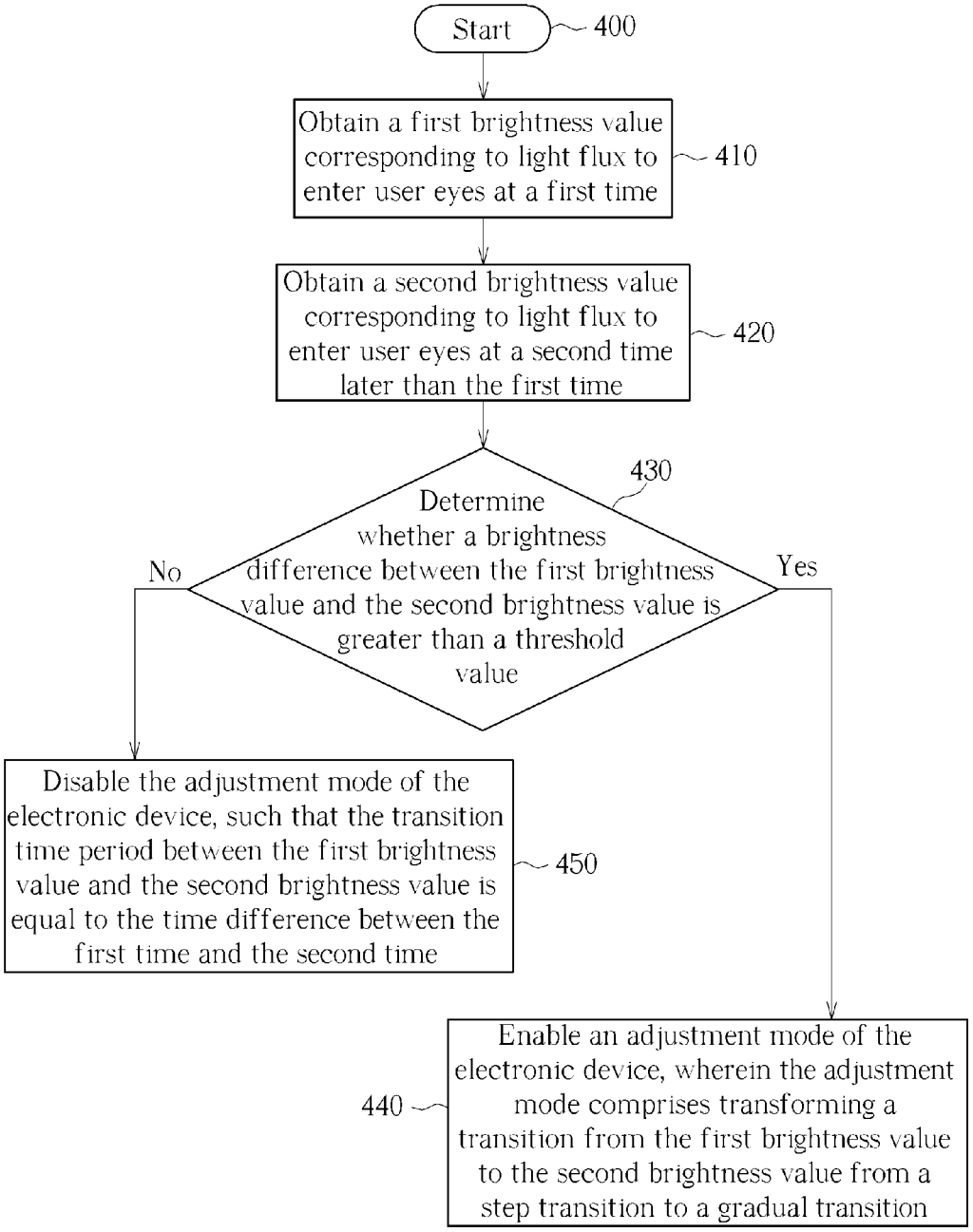
FIG. 4 is a second exemplary flowchart showing a method in accordance with operation schemes of an electronic device capable of performing a display adjustment in one embodiment.

Please refer to FIG. 4. FIG. 4 is a second exemplary flowchart showing a method in accordance with operation schemes of an electronic device capable of performing a display adjustment in one embodiment. The method may be applied to the apparatus 100 or the electronic device 100 in FIG. 2 but not limited thereto. Provided that the result is substantially the same, the steps in FIG. 4 are not required to be executed in the exact order shown in FIG. 4. The method in accordance with the above embodiment of the electronic device 100 in the present invention comprises the following steps:

Step 400: Start.

Step 410: Obtain a first brightness value corresponding to light flux to enter user eyes at a first time.

Step 420: Obtain a second brightness value corresponding to light flux to enter user eyes at a second time later than the first time.

Step 430: Determine whether a brightness difference between the first brightness value and the second brightness value is greater than a threshold value.

Step 440: Enable an adjustment mode of the electronic device, wherein the adjustment mode comprises transforming a transition from the first brightness value to the second brightness value from a step transition to a gradual transition.

Step 450: Disable the adjustment mode of the electronic device, such that the transition time period between the first brightness value and the second brightness value is equal to the time difference between the first time and the second time.

According to one embodiment, to covert the step transition to the gradual transition, either or both of a time length of a transition period and a transition rate from the first brightness value to the second brightness can be adjusted. In adjusting the time length of the transition period which originally has a time length, the time length can be adjusted according to a brightness difference between the first brightness value and the second brightness value. In a non-limiting example, the time difference indicating an excessive or an abrupt variation is utilized to determine whether to adjust the time length. Specifically, in events where the brightness difference between the first brightness value and the second brightness value is greater than the threshold value, the transition period from the first brightness value to the second brightness has a first time length; and in events where the brightness difference between the first brightness value and the second brightness value is less than the threshold value, a transition period from the first brightness value to the second brightness has a second time length, wherein the first time length can be greater than the second time length. Details of each step can be analogized form the above embodiments and thus omitted here for brevity.

In another embodiment which may be implanted as the apparatus 200 of FIG. 1, the detecting unit 110 can be utilized for obtaining one or more brightness values according to display content brightness value and at least one of a backlight brightness value and an ambient brightness value, wherein each of the one or more brightness values affects light flux entering user eyes. In one embodiment, the one or more brightness values can comprise a plurality of brightness values corresponding to light flux to enter user eyes at different times, and the one or more predetermined conditions comprise a condition where a variation of the one or more brightness values with time indicates a variation exceeding a predetermined variation threshold. For example, the one or more brightness values can comprise a screen brightness value, and the one or more predetermined conditions can comprise a first condition where the screen brightness value is lower than a first threshold. In another example, the one or more brightness values may further comprise the environment brightness value, and the one or more predetermined conditions comprise a second condition where the ambient brightness value is lower than a second threshold.

The processing unit 120 can be configured for obtaining human eye capability information from a database or any storage form or a predefined formula implemented by software, hardware, or a combination thereof and judging whether the one or more brightness values satisfy one or more predetermined conditions. In events where the one or more brightness values satisfy one or more predetermined conditions, the processing unit 120 enables a display adjustment on brightness according to the human eye capability information.

The human eye capability information can reflect how the human eyes are capable of reacting to or sensing variation in brightness or light flux entering them. The human eye capability information in one embodiment can comprise at least one of human eye adapting information and human eye sensitivity information. The human eye adapting information may indicate how a human eye adaptive level changes during the transition. The human eye adapting information may indicate how a human eye sensitive level changes during the transition. By considering the capability of human eye to adapt to the variation in brightness or light flux entering them in the display adjustment, the embodiment can provide screen brightness easier for human eyes to perceive and thus greatly reduce the uncomfortable feeling of human eyes.

In addition, the display adjustment may comprise smoothing the variation of the brightness values with time. The smoothing the variation can comprise increasing a time length of the variation according to human eye adapting information. Moreover, the display adjustment can further comprise increasing contrast and then decreasing the contrast during the variation. Furthermore, the display adjustment in step 440 may further comprise enhancing saturation.

Figure 5:
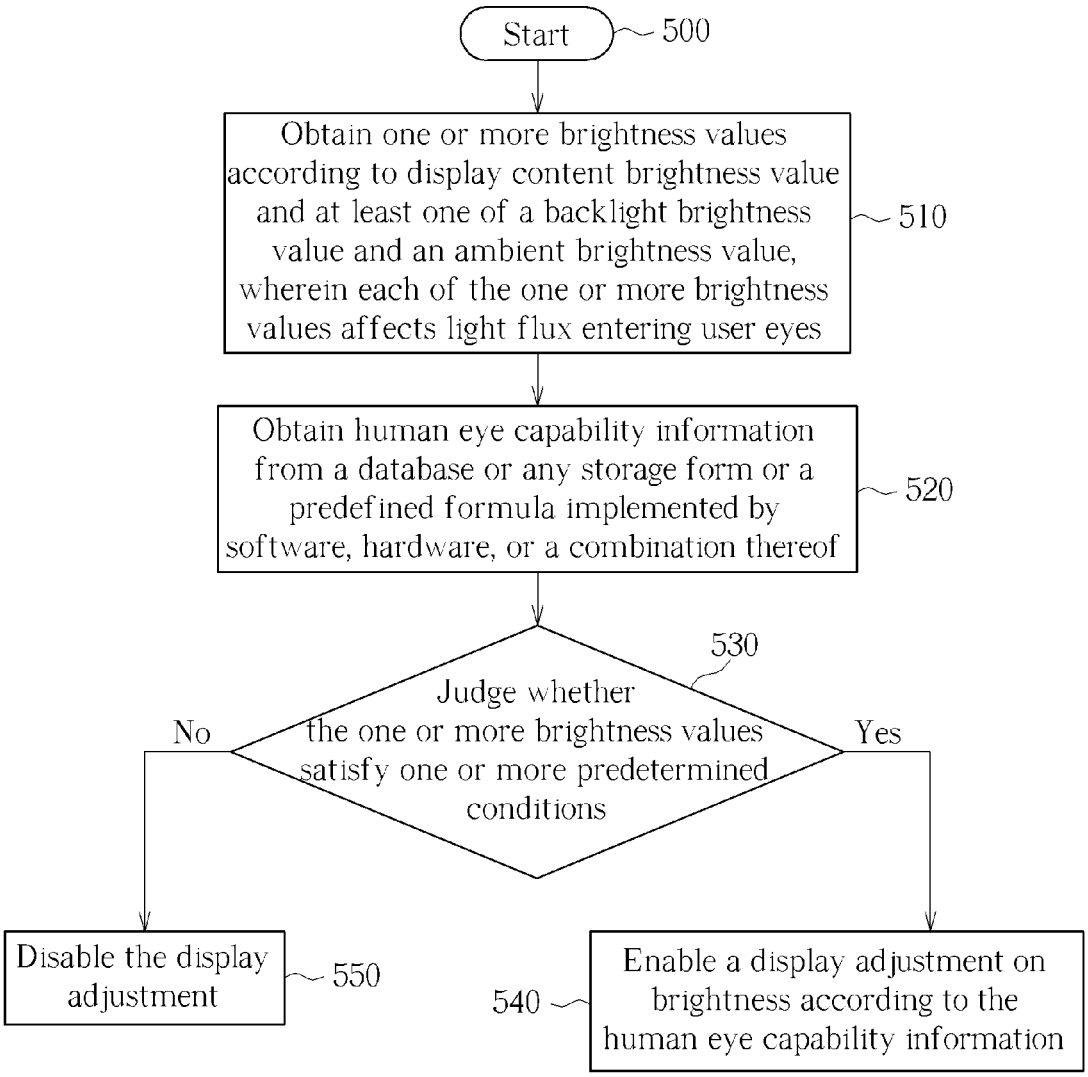
FIG. 5 is a third exemplary flowchart showing a method in accordance with operation schemes of an electronic device capable of performing a display adjustment in one embodiment.

Please refer to FIG. 5. FIG. 5 is a third exemplary flowchart showing a method in accordance with operation schemes of an electronic device capable of performing a display adjustment in one embodiment. The method may be applied to the apparatus 100 or the electronic device 100 in FIG. 2 but not limited thereto. Provided that the result is substantially the same, the steps in FIG. 5 are not required to be executed in the exact order shown in FIG. 5. The method in accordance with the above embodiment of the electronic device 100 in the present invention comprises the following steps:

Step 500: Start.

Step 510: Obtain one or more brightness values according to display content brightness value and at least one of a backlight brightness value and an ambient brightness value, wherein each of the one or more brightness values affects light flux entering user eyes.

Step 520: Obtain human eye capability information from a database or any storage form or a predefined formula implemented by software, hardware, or a combination thereof.

Step 530: Judge whether the one or more brightness values satisfy one or more predetermined conditions.

Step 540: Enable a display adjustment on brightness according to the human eye capability information. In a non-limiting example, the human eye capability information may provide a human eye capability. The image displaying produced according to the adjusted brightness may therefore fit or adapt to the human eye capability indicated by the human eye capability information.

Step 550: Disable the display adjustment.

The one or more brightness values in step 510 can comprise a plurality of brightness values corresponding to light flux to enter user eyes at different times. In one embodiment, the one or more predetermined conditions in step 530 comprise a condition where a variation of the one or more brightness values with time indicates a variation exceeding a predetermined variation threshold.

In one embodiment, the one or more brightness values comprise a screen brightness value, and the one or more predetermined conditions in step 530 can comprise a first condition where the screen brightness value is lower than a first threshold. Moreover, the one or more brightness values comprise the environment brightness value, and the one or more predetermined conditions in step 530 comprise a second condition where the ambient brightness value is lower than a second threshold.

On the other hand, the human eye capability information in step 520 can reflect how the human eyes are capable of reacting to or sensing variation in brightness or light flux entering them. The human eye capability information can comprise at least one of human eye adapting information and human eye sensitivity information. The human eye adapting information may indicate how a human eye adaptive level changes during the transition. The human eye adapting information may indicate how a human eye sensitive level changes during the transition. By considering the capability of human eye to adapt to the variation in brightness or light flux entering them in the display adjustment, the embodiment can provide screen brightness easier for human eyes to perceive and thus greatly reduce the uncomfortable feeling of human eyes.

The display adjustment in step 540 can comprise smoothing the variation of the brightness values with time. For example, the step of smoothing the variation comprises increasing a time length of the variation according to human eye adapting information. For example, the variation is smoothed to conform to either of both of the human eye adaptive level indicated by the human eye adapting information or the human eye sensitive level indicated by human eye sensitivity information. In this way, the variation can be more adapted to the human eye capability.

The display adjustment in step 540 can further comprise increasing contrast and then decreasing the contrast during the variation. In addition, the display adjustment may further comprise enhancing saturation of the pixel data. On the other hand, the display adjustment in step 540 may be performed on a screen brightness value, which for example, may be achieved by adjusting one or more of a backlight brightness value, a displayed content brightness value, an ancillary light of the screen, and one or more filtering devices of the screen. Details of each step can be analogized form the above embodiments and thus omitted here for brevity.

An embodiment of the disclosure also provides a non-transitory storage medium or a computer-readable recording medium. The non-transitory storage medium records at least one program instruction or program code. After being loaded into an electronic device with a screen, the at least one program instruction or program code is executed to carry out the method provided by each embodiment described above.

For example, after the at least one program instruction or program code in the computer-readable recording medium is loaded into the apparatus 200 illustrated in FIG. 1, the electronic device 100 runs the at least one program instruction or program code to execute the method provided by one of the embodiments described above. The computer-readable recording medium may be implemented as a memory accessible to electronic device 100 in FIG. 1. The computer-readable recording medium may be a read-only memory (ROM), a random-access memory (RAM), a CD-ROM, a tape, a floppy disk, or an optical data storage device.

Various functional components or blocks have been described herein. As will be appreciated by persons skilled in the art, the functional blocks will preferably be implemented through circuits (either dedicated circuits, or general purpose circuits, which operate under the control of one or more processors and coded instructions), which will typically comprise transistors that are configured in such a way as to control the operation of the circuitry in accordance with the functions and operations described herein. As will be further appreciated, the specific structure or interconnections of the transistors will typically be determined by a compiler, such as a register transfer language (RTL) compiler. RTL compilers operate upon scripts that closely resemble assembly language code, to compile the script into a form that is used for the layout or fabrication of the ultimate circuitry. Indeed, RTL is well known for its role and use in the facilitation of the design process of electronic and digital systems.

Briefly summarized, the method and the electronic device disclosed by the embodiments can adjust display of an electronic device by enabling the adjustment mode of the electronic device to adjust the brightness of the screen to increase a transition time period when the brightness variation is large. In addition, the adjustment can be performed based on human eye capability information, which may comprise either of both of human eye adapting information and human eye sensitivity information. By considering the capability of human eye to adapt to the variation in brightness or light flux entering them in the display adjustment, the embodiment can make screen brightness easier for human eyes to perceive and thus greatly reduce the uncomfortable feeling of human eyes. Accordingly, the embodiments can solve the problem that user eyes are not able to instantly adapt to the large brightness variation in and clearly see the display content.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for adjusting display of an electronic device, comprising:

obtaining a first brightness value corresponding to light flux to enter user eyes at a first time;

obtaining a second brightness value corresponding to light flux to enter user eyes at a second time later than the first time;

determining whether a brightness difference between the first brightness value and the second brightness value is greater than a threshold value; and in events where the brightness difference between the first brightness value and the second brightness value is greater than the threshold value, enabling an adjustment mode of the electronic device, wherein the adjustment mode comprises:

increasing a transition time period of a transition from the first brightness value to the second brightness value, such that the increased transition time period between the first brightness value and the second brightness value is longer than a time difference between the first time and the second time; and adjusting a screen brightness value to be displayed on a screen according to the transition from the first brightness value to the second brightness value with the increased transition time.

2. The method for adjusting display of the electronic device of claim 1, wherein the time difference between the first time and the second time is equal to a frame update period.

3. The method for adjusting display of the electronic device of claim 1, wherein the step of obtaining the first brightness value corresponding to light flux to enter human eyes at the first time comprises determining the first brightness value according to a first screen brightness value to be displayed on a screen at the first time and an ambient brightness value, and wherein the step of obtaining the second brightness value corresponding to light flux to enter human eyes at the second time comprises determining the second brightness value according to a second screen brightness value to be displayed on the screen at the second time and the ambient brightness value.

4. The method for adjusting display of the electronic device of claim 3, wherein the first brightness value is a weighted sum of the first screen brightness value and the ambient brightness value, and wherein the second brightness value is a weighted sum of the second screen brightness value and the ambient brightness value.

5. The method for adjusting display of the electronic device of claim 1, wherein the step of adjusting the screen brightness value to be displayed on the screen comprises adjusting either or both of a backlight brightness value and a displayed content brightness value.

6. The method for adjusting display of the electronic device of claim 1, wherein the step of adjusting the screen brightness value to be displayed on the screen comprises adjusting either or both of an ancillary light disposed for the screen or a transmission rate or a shading rate of one or more filtering devices of the screen.

7. The method for adjusting display of the electronic device of claim 1, wherein the adjustment mode further comprises:

adding a contrast variation to brightness during the transition time period.

8. The method for adjusting display of the electronic device of claim 7, further comprising:

obtaining a first contrast value to be displayed on a screen of the electronic device at the first time; and obtaining a second contrast value to be displayed on the screen at the second time;

wherein the step of adding the contrast variation during transition time period comprises:

during the transition time period, first increasing a contrast value from the first contrast value and then gradually decreasing the contrast value to the second contrast value.

9. The method for adjusting display of the electronic device of claim 1, wherein the adjustment mode further comprises obtaining human eye brightness adapting information, and wherein the transition time period between the first brightness value and the second brightness value is increased according to the human eye brightness adapting information.

10. The method for adjusting display of the electronic device of claim 9, wherein the human eye brightness adapting information comprises a human eye adapting rate, and wherein the step of increasing the transition time period between the first brightness value and the second brightness value comprises gradually increasing a brightness value corresponding to light flux to enter user eyes from the first brightness value to the second brightness value with an increment, wherein the increment is proportional to the human eye adapting rate.

11. The method for adjusting display of the electronic device of claim 10, wherein the step of obtaining the human eye adapting rate comprises:

obtaining a human eye adapting level corresponding to light flux currently entering user eyes; and determining the human eye adapting rate by referring to a preconfigured human eye adapting function with the human eye adapting level.

12. The method for adjusting display of the electronic device of claim 1, further comprising:

in events where the brightness difference between the first brightness value and the second brightness value is less than the threshold value, disabling the adjustment mode of the electronic device, such that the transition time period between the first brightness value and the second brightness value is equal to the time difference between the first time and the second time.

13. An electronic device capable of performing a display adjustment, comprising:

a detecting unit, configured to obtain a first brightness value corresponding to light flux to enter user eyes at a first time and obtain a second brightness value corresponding to light flux to enter user eyes at a second time later than the first time; and a processing unit, configured to determine whether a brightness difference between the first brightness value and the second brightness value is greater than a threshold valued, wherein:

in events where the brightness difference between the first brightness value and the second brightness value is greater than the threshold value, the processing unit enables an adjustment mode of the electronic device, in the adjustment mode, the processing unit increases a transition time period of a transition from the first brightness value to the second brightness value, such that the increased transition time period between the first brightness value and the second brightness value is longer than a time difference between the first time and the second time, and the processing unit adjusts a screen brightness value to be displayed on a screen according to the transition of the second brightness value to the first bright value with the increased transition time.

14. The electronic device capable of performing a display adjustment of claim 13, wherein in the obtaining the first brightness value corresponding to light flux to enter human eyes at the first time, the detecting unit determines the first brightness value according to a first screen brightness value to be displayed on a screen at the first time and an ambient brightness value, and in the obtaining the second brightness value corresponding to light flux to enter human eyes at the second time, the detecting unit determines the second brightness value according to a second screen brightness value to be displayed on the screen at the second time and the ambient brightness value.

15. The electronic device capable of performing a display adjustment of claim 13, wherein in the adjusting the screen brightness value to be displayed on the screen, the processing unit adjusts at least one of a backlight brightness value and a displayed content brightness value.

16. The electronic device capable of performing a display adjustment of claim 13, wherein in the adjusting the screen brightness value to be displayed on the screen, the processing unit adjusts either or both of an ancillary light disposed for the screen or a transmission rate or a shading rate of one or more filtering devices of the screen.

17. The electronic device capable of performing a display adjustment of claim 13, wherein in the adjustment mode, the processing unit is further configured to add a contrast variation to brightness during the transition time period.

18. The electronic device capable of performing a display adjustment of claim 17, wherein the detecting unit is further configured to obtain a first contrast value to be displayed on a screen of the electronic device at the first time and obtain a second contrast value to be displayed on the screen at the second time, and wherein in the adding the contrast variation during transition time period, the processing unit first increases a contrast value from the first contrast value and then gradually decreases the contrast value to the second contrast value during the transition period.

19. The electronic device capable of performing a display adjustment of claim 13, wherein in the adjustment mode, the processing unit obtains human eye brightness adapting information and wherein the processing unit increases the transition time period between the first brightness value and the second brightness value according to the human eye brightness adapting information.

20. The electronic device capable of performing a display adjustment of claim 19, wherein the human eye brightness adapting information comprises a human eye adapting rate and wherein the function of increasing the transition time period between the first brightness value and the second brightness value comprises gradually increasing a brightness value corresponding to light flux to enter user eyes from the first brightness value to the second brightness value with an increment, wherein the increment is proportional to the human eye adapting rate.

21. The electronic device capable of performing a display adjustment of claim 20, wherein in the obtaining the human eye adapting rate, the processing unit obtains a human eye adapting level corresponding to light flux currently entering user eyes and determines the human eye adapting rate by referring to a preconfigured human eye adapting function with the human eye adapting level.

22. The electronic device capable of performing a display adjustment of claim 13, wherein in events where the brightness difference between the first brightness value and the second brightness value is less than the threshold value, and wherein the processing unit disables the adjustment mode of the electronic device, such that the transition time period between the first brightness value and the second brightness value is equal to the time difference between the first time and the second time.

* * * * *